United States Patent [19]

Campbell

[11] Patent Number: 4,556,208

[45] Date of Patent: Dec. 3, 1985

[54] WEB SKEWING APPARATUS

[75] Inventor: Roscoe Campbell, Dayton, Ohio

[73] Assignee: Harris Graphics Corporation, Melbourne, Fla.

[21] Appl. No.: 638,326

[22] Filed: Aug. 6, 1984

[51] Int. Cl.[4] ..... B65H 39/00

[52] U.S. Cl. ..... 270/52; 226/21

[58] Field of Search ..... 270/52, 10, 43; 226/4, 226/21, 108, 114, 174, 180

[56] References Cited

U.S. PATENT DOCUMENTS

| | | | |
|---|---|---|---|
| 3,017,062 | 1/1962 | Watt et al. | 226/180 |
| 3,147,969 | 9/1964 | Martin | 270/52 |
| 3,160,409 | 12/1964 | Lucas | 270/52 X |
| 3,193,086 | 7/1965 | Wilhelm | 226/21 X |
| 3,595,459 | 7/1971 | Colombo | 226/21 |
| 3,608,796 | 9/1971 | Morse | 226/21 |
| 3,682,468 | 8/1972 | Schriber | 270/52 |
| 3,958,736 | 5/1976 | Pounds | 226/21 |
| 4,090,432 | 5/1978 | Hobart | 226/21 X |
| 4,481,068 | 11/1984 | Richey | 270/52 |

FOREIGN PATENT DOCUMENTS

| | | | |
|---|---|---|---|
| 1212385 | 3/1966 | Fed. Rep. of Germany | 226/21 |

*Primary Examiner*—E. H. Eickholt

*Attorney, Agent, or Firm*—Biebel, French & Nauman

[57] ABSTRACT

A plurality of skewing devices are mounted in a collating apparatus above collating points at which a plurality of webs are collected together for further processing. The skewing devices comprise rollers mounted on shafts which may be rotated by a handle. Each shaft has a threaded section, and a threaded block is mounted thereon for axial movement in response to rotation of the handle. There is a link bar pivotally linked to the threaded block, so that axial movement of the threaded block causes pivotal rotation of the link bar. Such pivotal rotation of the link bar causes the threaded block to rotate the shaft in a horizontal plane for controlled skewing of the web.

13 Claims, 6 Drawing Figures

WEB SKEWING APPARATUS

BACKGROUND OF THE INVENTION

This invention relates to apparatus for controlling the alignment of moving webs and has particular application to collators. Typical collators for such application of the invention are shown in Schriber U.S. Pat. No. 3,682,468. In such collators a plurality of marginally perforated webs of paper are directed horizontally toward a series of spaced rollers and thence downwardly toward a horizontally moving pin conveyor. Just prior to reaching the conveyor the webs engage feed wheels which guide them into accurately registered overlying relationship against the conveyor. For satisfactory operation of the collator it is necessary to control the alignment of the moving webs to a high degree of accuracy. There has been an ever increasing need to control the accuracy of such web placement and to ease the job of the operator responsible therefor.

SUMMARY OF THE INVENTION

The present invention improves the prior art collation process by providing means for horizontally pivoting those web guide rollers which are positioned above the feed wheels. Such horizontal pivoting provides a web path alignment which may be accurately adjusted by conveniently accessible operator controls.

In accordance with this invention horizontal roller pivoting is provided by mounting the roller upon a shaft which is threaded near one end. A threaded block is mounted on the threaded end of the shaft, so that rotation of the shaft produces axial movement of the threaded block. Skewing means are mounted in relation to the shaft such that axial movement of the threaded block causes horizontal pivoting motion of the shaft about a pivot point inward from the threaded end. A pivotal support means, such as a flange block, provides support for the shaft at the pivot point.

In preferred embodiment the skewing means comprises a fixed mounting plate and a link bar pivotally mounted between the mounting plate and the threaded block. Link bar mounting may be accomplished by a first linking means which pivotally link the link bar to the threaded block and second linking means which pivotally link the link bar to the mounting plate. A bearing bar may be provided for preventing motion of the shaft in a direction away from the mounting plate, and a handle may be mounted on the shaft at the end opposite the threaded block. The roller is preferably mounted on the shaft intermediate the flange block and the handle.

It is therefore an object of this invention to provide improved web positioning in a collating apparatus.

It is another object of this invention to provide improved apparatus for adjusting the direction of movement of a web.

These and other objects of the invention will be apparent from the following description, the attached drawings, and the appended claims.

DESCRIPTION OF THE PREFERRED EMBODIMENT

Figure 1:
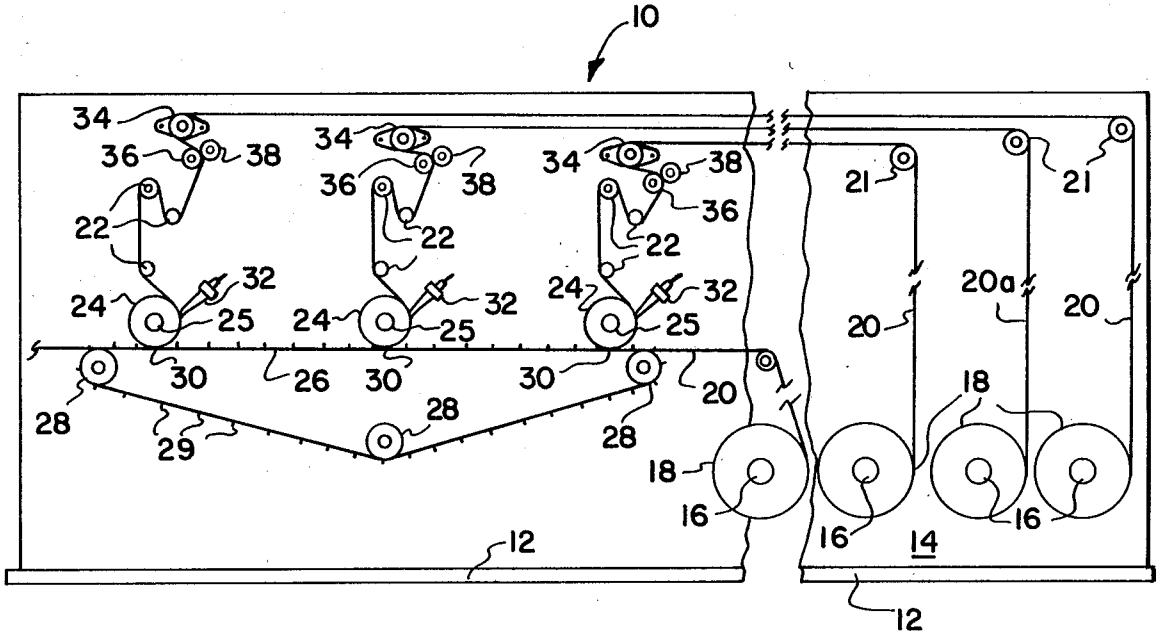
FIG. 1 is a schematic side view of a typical collator incorporating web skewing apparatus according to the present invention.

FIG. 1 illustrates the manner of application of a plurality of web skewing devices 34 to a collating apparatus 10. The details of a web skewing device 34 are illustrated in FIGS. 2 through 6. Collating apparatus 10 may be of the general type described in the above-mentioned U.S. Pat. No. 3,682,468 and may include an elongated base 12 from which extends a vertical frame or wall 14. A series of horizontally arranged parallel spindles 16 are supported extending outwardly from the wall 14 for free rotation and receive corresponding rolls 18 of paper webs 20 (only three shown), each having longitudinally spaced marginal perforations or feed holes, and (if desired) intermediate carbon tissue webs **20*a* (only one shown). Typically, the webs are directed by a series of rollers 21 to a series of horizontally oriented rollers 44, which in the case of the present invention, are incorporated into the skewing devices 34. After passage about rollers 44 each web is directed downwardly and reversely into a nip formed between a pull roller 36 and a gripper roller 38. Thereafter, the web is guided about a series of guide rollers 22 for downward travel to a feed wheel 24 mounted for adjustment lengthwise of a rotatably shaft 25 positioned above an endless pin conveyor 26. Pin conveyor 26 is carried by pulleys 28 and advanced from right to left as viewed in FIG. 1 by a suitable drive (not shown). The same drive rotates shafts 25, which in turn rotate wheels 24** at a speed which matches the peripheral speed of the wheels to the conveyor speed.

Pin conveyor 26 is fitted with a series of protrusions or pins 29 spaced apart to engage through the feed holes of the paper webs 20, and into matching slots (not illustrated) in the wheels 24. This produces web collation at a series of collating points 30. A series of glue nozzles 32 may be provided for application of glue spots to the webs as required for joining thereof.

Figure 2:
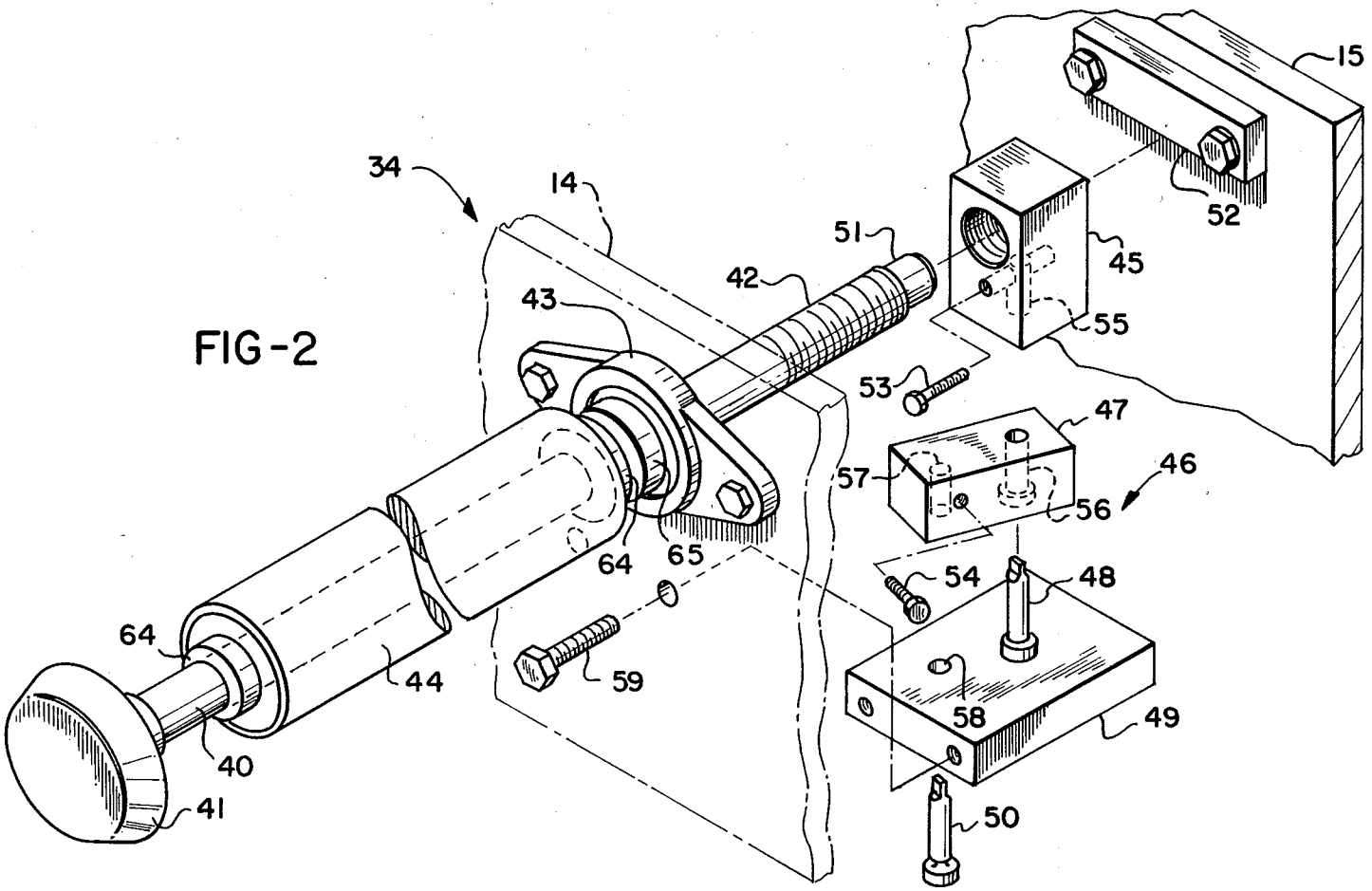
FIG. 2 is a partially exploded isometric drawing of a web skewing apparatus.
Figure 3:
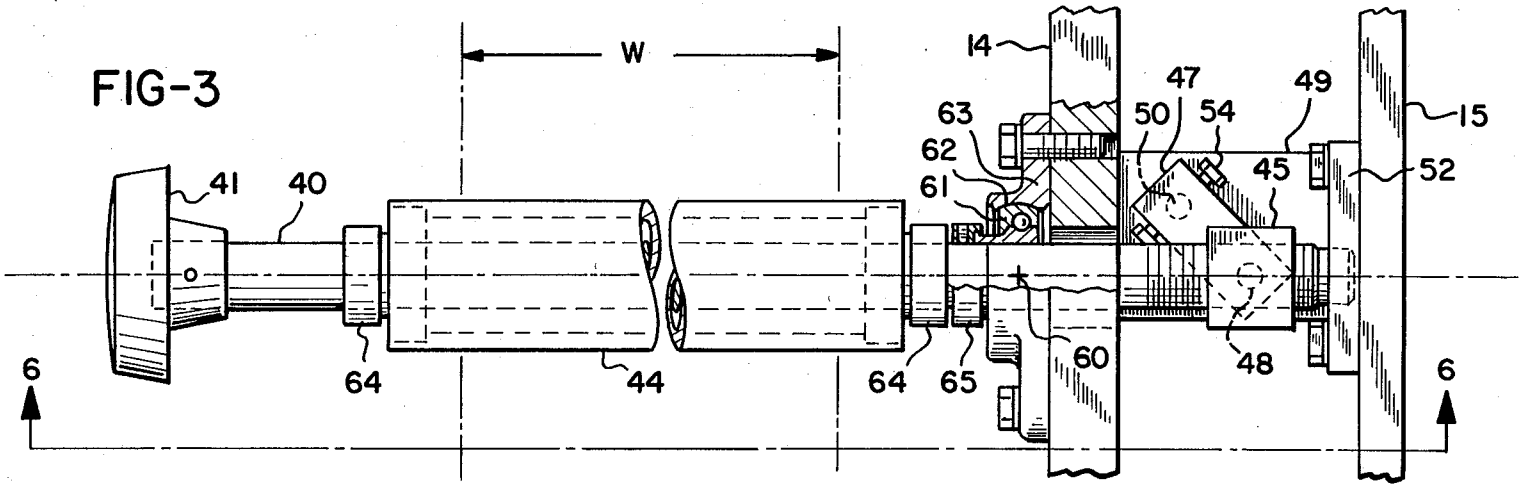
FIG. 3 is a horizontal plan view of the web skewing apparatus of FIG. 2.

Referring now to FIG. 2, it will be seen that a skewing apparatus 34 may comprise a shaft 40 upon which are fixed a pair of bearings 64, 64 for supporting the roll 44. Shaft 40 is pivotally supported by pivotal support means comprising a flange block 43 mounted on wall 14. Flange block 43 is a widely available device having an internal construction as generally illustrated in FIG. 3. Thus flange block 43 may comprise a bearing 61 having an arcuate surface 62 to facilitate pivotal rotation inside a housing 63. A locking collar 65 is provided for secure attachment of the flange block to shaft 40.

As also illustrated by FIG. 2, that portion of shaft 40 projecting through flange block 43 and beyond wall 14 has a threaded section 42 disposed immediately inboard of a smooth end 51. Shaft 40 is threaded into a threaded block 45 with smooth end 51 projecting therethrough and bearing against the lower surface of a bearing bar 52 mounted on a rear wall 15. (See FIG. 6)

Figure 4:
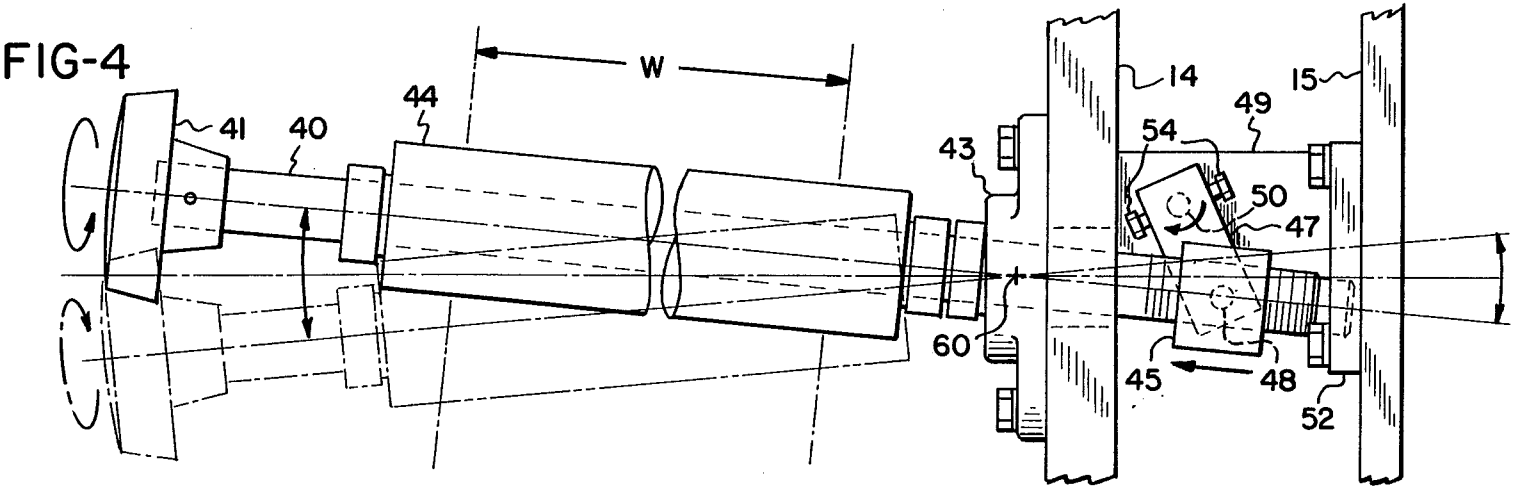
FIGS. 4 and 5 are horizontal plan views illustrating pivotal motion of the apparatus of FIGS. 2 and 3.
Figure 5:
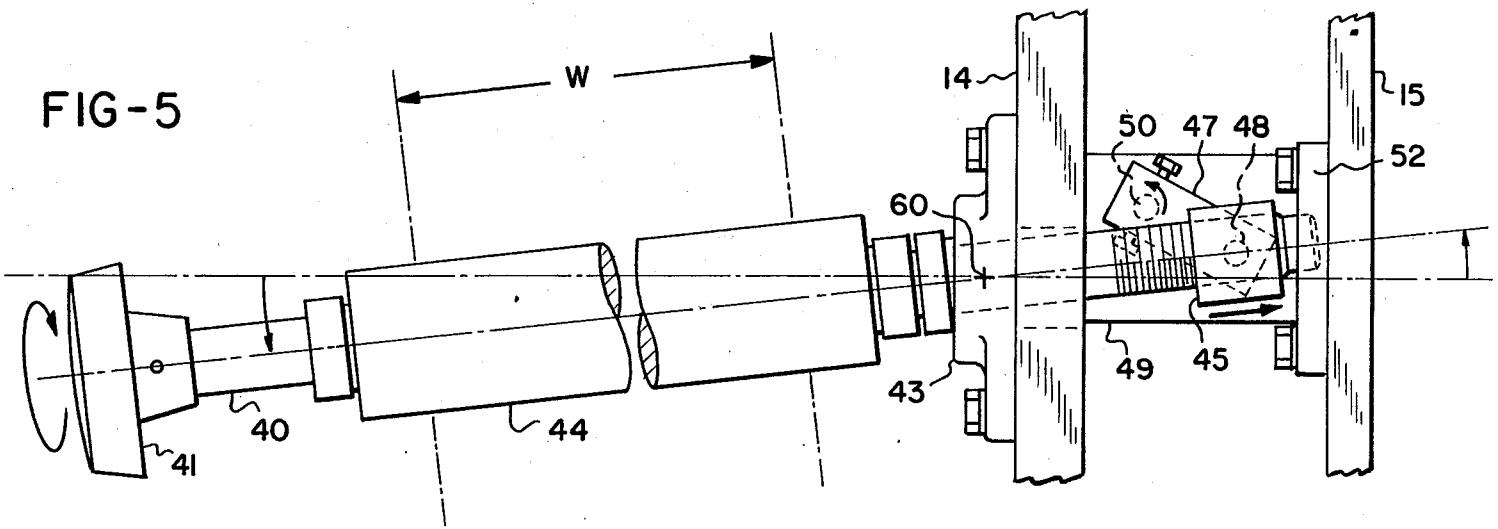

Skewing apparatus 34 further comprises skewing means 46 mounted below threaded block 45 such that axial movement of threaded block 45 along threads 42 of shaft 40 produces pivoting motion in a horizontal plane as illustrated in FIGS. 4 and 5. A handle 41 is provided for rotating shaft 40 to produce the required axial movement of threaded block 45. Because of the positioning of skewing apparatus 34 immediately above collating points 30, handles 41 are readily accessible to the operator who is normally attending to other nearby controls (not illustrated). It will be appreciated that other rotation means may be utilized, as, for instance, a motor driven belt and a pulley. Such rotation means could be used in combination with a web position sensor and a feedback controller.

In the preferred embodiment skewing means 46 comprises a mounting plate 49 fixed to wall 14 by a pair of bolts 59, 59 (only one bolt 59 being visible in FIG. 2) and a link bar pivotally linked between mounting plate 49 and threaded block 45. Link bar 47 is provided with an aperture 56 for receiving a first linking means in the form of a pivot pin 48 and another aperture 57 for receiving a second linking means in the form of a pivot pin 50. Pivot pin 48 passes through aperture 56 and into another aperture 55 in threaded block 45. Pivot pin 48 is secured in place within threaded block 45 by means of a pair of screws 53, 53 (only one screw 53 being illustrated in FIG. 2. This completes the linking of link bar bar 47 to threaded block 45. Pivot pin 50 passes through an aperture 58 in mounting plate 49 for entry into aperture 57 of link bar 47. A pair of screws 54, 54 (only one of which is illustrated in FIG. 2) are provided for securing pivot pin 50 in place within link bar 47 and completing the link to mounting plate 49.

In operation, a web 20 may be guided along roller 44 in the region designated by the letter W in FIGS. 3 through 5. As handle 41 is operated to rotate shaft 40 about its axis, threaded block 45 progresses along shaft 40 in a direction dependent upon the direction of rotation of handle 41; inward movement being illustrated in FIG. 4 and outward movement being illustrated in FIG. 5. Axial movement of threaded block 45 causes concomitant axial movement of pivot pin 48, so that link bar 47 is rotated about pivot pin 50. Rotation of link bar 47 causes shaft 40 to rotate about a pivot point 60 within flange block 43. This produces steering of the web as illustrated by FIGS. 4 and 5.

Figure 6:
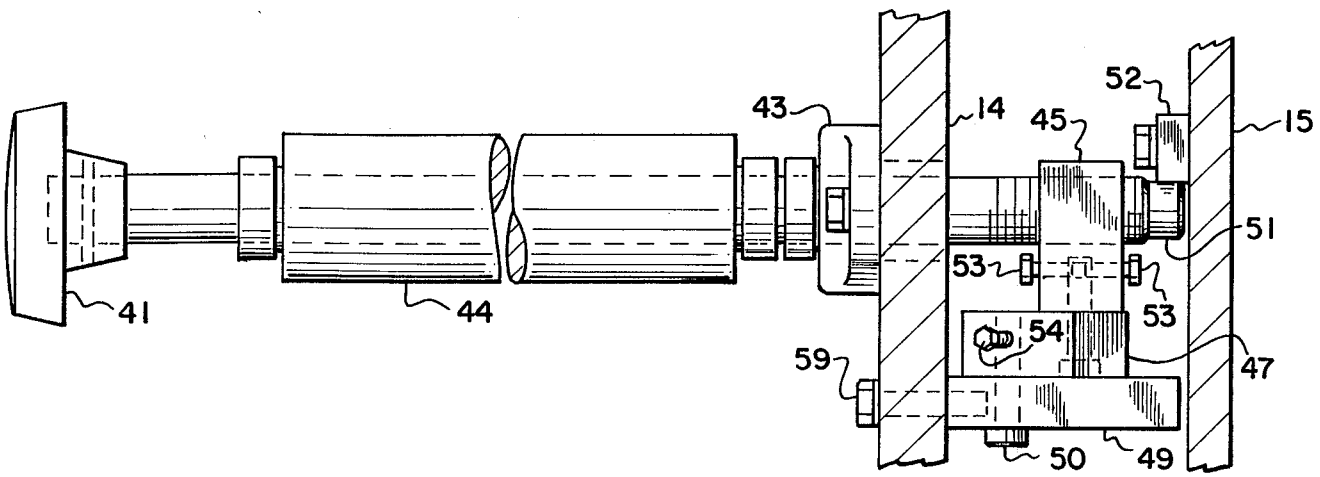
FIG. 6 is a side elevation view of the web skewing apparatus.

As best illustrated in FIG. 6, shaft 40 is sandwiched between bearing bar 52 and mounting plate 49. This prevents vertical movement of shaft 40 and confines all pivotal motion to the horizontal plane.

It will be appreciated that while skewing means 46 has been illustrated as comprising a link bar and mounting plate arrangement, a cam or other mechanism could be used. Thus it should be understood that the invention is not limited to the form of apparatus as shown and described, and that changes may be made therein without departing from the scope of the invention.

What is claimed is:

1. Web skewing apparatus comprising:

a shaft which has a threaded portion near one end, rotation means for axial rotation of said shaft, pivotal support means for pivotally supporting said shaft at a pivot point inward from said threaded portion, a roller mounted on said shaft for supporting a web to be skewed, a threaded block threadably mounted on said shaft along said threaded portion for axial movement in response to rotation of said shaft, a link bar pivotally linked to said threaded block, and a fixed mounting plate pivotally linked to said link bar such that axial movement of said threaded block causes pivotal motion of said shaft.

2. Web skewing apparatus according to claim 1 wherein said roller and said threaded block are mounted on said shaft on opposite sides of said pivot point.

3. Web skewing apparatus according to claim 2 wherein said rotation means comprises a handle mounted on said shaft outboard of said roller.

4. Web skewing apparatus according to claim 3 and further comprising a bearing bar for bearing against said shaft to prevent motion thereof in a direction away from said mounting plate.

5. Web skewing apoaratus comprising:

a shaft which has a threaded region, rotation means for axial rotation of said shaft, pivotal support means for pivotally suoporting said shaft at a pivot point therealong, a roller mounted on said shaft for supporting a web to be skewed, a threaded block threadably mounted on said shaft along said threaded region for axial movement in response to operation of said rotation means, and skewing means for causing pivotal motion of said shaft and said roller about said pivot point in response to axial movement of said threaded block.

6. Web skewing apparatus according to claim 5 wherein said rotation means comprises a handle mounted on said shaft at one end.

7. Apparatus according to claim 6 wherein said roller is mounted on said shaft intermediate said pivot point and said handle.

8. Apparatus according to claim 7 wherein said skewing means comprises:

a link bar, first linking means for pivotally linking said link bar to said threaded block, a fixed mouning plate, and second linking means for pivotally linking said link bar to said mounting plate in such a manner that axial movement of said threaded block produces concomitant sideward movement thereof.

9. Apparatus according to claim 8 wherein said pivotal support means comprises a flange block.

10. Apparatus according to claim 9, said shaft having a smooth end portion projecting beyond said threaded region; said apparatus further comprising a bearing bar for slidably supoorting said smooth end portion against motion in a direction away from said mounting plate.

11. In a collating apparatus comprising a plurality of horizontally oriented rollers, supply means for supplying a plurality of perforated webs to said rollers, a horizontally driven conveyor positioned below said rollers for receiving said webs therefrom, and a plurality of feed wheels positioned above said conveyor for applying said webs thereto at collating points which are generally below said rollers; the improvement wherein a plurality of skewing devices are provided for causing horizontal pivotal motion of said rollers so that said webs are aligned prior to collation thereof; each of said skewing devices comprising:

a shaft for supporting one of said rollers, a flange block for pivotally supporting said shaft, a handle for axially rotating said shaft, an axially movable block mounted on said shaft for axial movement in response to rotation of said handle, and skewing means for causing said horizontal pivotal motion in response to axial movement of said block.

12. The improvement of claim 11 wherein said skewing means comprises a fixed mounting plate and a link bar pivotally mounted between said mounting plate and said movable block.

13. The improvement of claim 11 wherein said webs are directed downwardly and reversely about said rollers.

* * * * *